US006520259B1

(12) United States Patent
Rasmussen et al.

(10) Patent No.: US 6,520,259 B1
(45) Date of Patent: Feb. 18, 2003

(54) METHOD AND APPARATUS FOR FLUID ENTRAINMENT

(76) Inventors: Jeremy Mathew Rasmussen, 2320 Sandpiper, Lapeer, MI (US) 48446; James R. Burns, 5848 Wood Valley, Haslett, MI (US) 48540; David Lawrence Schroder, P.O. Box 62, Sylvania, OH (US) 43560; Daniel William Oberle, 5114 Maple Dr., Sylvania, OH (US) 43560

( * ) Notice: Subject to any disclaimer, the term of this patent is extended or adjusted under 35 U.S.C. 154(b) by 0 days.

(21) Appl. No.: 09/975,204

(22) Filed: Oct. 11, 2001

(51) Int. Cl.[7] ..... E21B 43/00

(52) U.S. Cl. ..... 166/310; 166/54; 166/88.1; 166/105.6; 166/334.4

(58) Field of Search ..... 166/310, 311, 166/369, 370, 372–374, 386, 53, 54, 68, 69, 72, 88.1, 105, 105.6, 334.4

(56) References Cited

U.S. PATENT DOCUMENTS

| | | | | |
|---|---|---|---|---|
| 3,855,656 | A | * | 12/1974 | Blenkarn |
| 3,933,108 | A | * | 1/1976 | Baugh |
| 3,952,526 | A | * | 4/1976 | Watkins et al. |
| 4,323,122 | A | | 4/1982 | Knopik |
| 4,470,722 | A | * | 9/1984 | Gregory |
| 4,844,797 | A | | 7/1989 | Wells |
| 5,050,676 | A | | 9/1991 | Hess et al. |
| 5,172,764 | A | | 12/1992 | Hajali et al. |
| 5,197,541 | A | | 3/1993 | Hess et al. |
| 5,220,961 | A | * | 6/1993 | Guesnon et al. |
| 5,271,467 | A | | 12/1993 | Lynch |
| 5,358,357 | A | | 10/1994 | Mancini et al. |
| 5,380,125 | A | | 1/1995 | Croy |
| 5,464,309 | A | | 11/1995 | Mancini et al. |
| 6,024,868 | A | | 2/2000 | Salotti et al. |

OTHER PUBLICATIONS

Byron C. Sakiadis, Fluid and Particle Mechanics, Perry's Chemical Engineering Handbook, Chapter 5, pp. 5–40 to 5–48, Sixth Edition (1984)., McGraw–Hill Book Co., New York.

* cited by examiner

*Primary Examiner*—Roger Schoeppel

(57) ABSTRACT

The present invention presents an improved method and apparatus for liquid entrainment by a two-phase flow system. The present invention provides an apparatus that recovers liquids by entrainment without experiencing deadhead conditions, choking or dry recovery due to fluctuations in the elevation of the liquid level. The apparatus provides self-regulated two-phase recovery of gas and liquid by construction design, thus eliminating the need for manual adjustments or electronically controlled devices. The enhanced venturi effects of the present invention enhance liquid lift while maintaining the gas recovery point above the liquid at all times to eliminate deadhead conditions.

18 Claims, 7 Drawing Sheets

METHOD AND APPARATUS FOR FLUID ENTRAINMENT

CROSS-REFERENCE TO RELATED APPLICATIONS

Not Applicable.

STATEMENT REGARDING FEDERAL RESEARCH AND DEVELOPMENT

Not Applicable.

BACKGROUND—FIELD OF INVENTION

A method and apparatus for automatically maintaining two-phase entrainment flow of liquid from a well or reservoir while preventing flow stoppage from problems such as liquid-filled pipes, deadhead conditions, choking or dry recovery.

BACKGROUND—DESCRIPTION OF PRIOR ART

Contaminated properties are commonly remediated by extracting contaminated groundwater from the subsurface using entrainment methods. The simplest approach to liquid entrainment involves connecting a vacuum blower or vacuum pump to a well to simultaneously extract liquid and gases from the well (Hess et al., U.S. Pat. Nos. 5,050,676 and 5,197,541). However, this technique provides poor liquid entrainment unless high vacuums are used and the water table is relatively shallow. The more common technique of entrainment involves connecting a vacuum pump or vacuum blower to an entrainment tube that is extended into a well just above or slightly below the water table for recovery of fluids and gases (Salotti et al., U.S. Pat. No. 6,024,868; Mancini et al., U.S. Pat. Nos. 5,358,357 and 5,464,309; Knopik, U.S. Pat. No. 4,323,122; and Hajali et al., U.S. Pat. No. 5,172,764). When the vacuum pump or blower is turned on, the liquid is pulled into the pipe by vacuum and carried through the pipe by entrainment. The technical concepts of two-phase entrainment flow have been the focus of much historical experimentation and theoretical study. The concepts are summarized in Perry's Chemical Engineering Handbook, Sixth Edition (1984) on pages 5–40 to 5–48. The theory and design concepts of two-phase entrainment will not be explained in detail herein since the concepts are used in common practice and are well understood by those skilled in the art.

Perry's Chemical Engineering Handbook describes several ranges oftwo-phase flow that are classified based on the gas-to-liquid ratio maintained during transfer. Most remedial systems typically tend to operate in the range of annular flow or slug flow. This means that most remedial liquid entrainment methods operate at liquid-to-gas ratios of less than 0.25 gallons of liquid per cubic feet of gas and at entrainment velocities greater than 900 feet per minute. The successful operation of a remedial entrainment system often relies on the ability to maintain these liquid-to-gas relationships. The most common form of gas recovery in remedial systems is air.

Groundwater elevation fluctuations occur at many remediation sites due to precipitation and changes in barometric pressure. At low groundwater elevation conditions, the water table falls below the elevation of the entrainment tube so that water entrainment cannot occur, thus resulting in dry recovery. Dry recovery refers to the recovery of gas with no entrained liquids. At high water table conditions, the elevation of the groundwater covers the end of the vacuum entrainment tube with water, thus making it impossible for the pipe to recover air. When the bottom of the entrainment pipe is covered with water, the vacuum inside the entrainment tube will pull water up into the pipe to an elevation where the head of water is equivalent to the lift vacuum. This phenomena is often referred to as a "deadhead" condition. In other instances of high water table conditions, the entrainment system may be able to keep up with the increased rate of water recovery for a period of time, only to eventually shutdown due to flooded pipes and manifolds. This phenomena is referred to as "choking." Deadhead conditions and choking are common in remedial systems that rely on entrainment recovery techniques. These conditions are the cause of excessive system down-time and increased operational costs for many remedial systems.

Remedies to correct deadhead and choking conditions have been attempted such as placing holes or vacuum relief valves into the sides of the entrainment tube. These methods, however, have been largely unsuccessful. Entrainment tubes with side holes tend to allow air to flow preferentially through the unrestricted side openings without allowing for entrainment of water at the bottom of the tube. In designs with a side-mounted vacuum relief valve, the vacuum required to open the valve tends to maintain "deadhead" conditions at the bottom of the entrainment tube, thus resulting in only dry recovery. Entrainment systems that rely on void-space buoyancy have failed by fluid displacement within the voids.

Entrainment systems have been devised where air is injected or introduced into a well to enhance the gas-to-liquid ratio and prevent deadhead conditions (Salotti et al., U.S. Pat. No. 6,024,868; Mancini et al., U.S. Pat. Nos. 5,358,357 and 5,464,309; Hess et al., U.S. Pat. No. 5,197,541; and Hajali et al., U.S. Pat. No. 5,172,764). In the alternative, Hess et al. in U.S. Pat. No. 5,197,541 requires a second air injection well to enhance subsurface gas-to-liquid ratios. However, these systems are ineffective where there is large fluctuations in the groundwater table or for highly permeable soils where the introduced air cannot adequately compensate for the increased groundwater flow into the well.

Complex electronic control systems have also been devised in an attempt to better control the gas-to-liquid recovery ratios in order to maintain an operable system (Salotti et al., U.S. Pat. No. 6,024,868 and Wells, U.S. Pat. No. 4,844,797). However, these systems are complex, expensive and time-consuming to install. Furthermore, they do not resolve the complex problem of creating a system that functions with widely fluctuating water tables.

Finally, others have resorted to systems that separately recover liquid and gas from the well in order to avoid the complications of fluid entrainment (Lynch, U.S. Pat. No. 5,271,467 and Croy, U.S. Pat. No. 5,380,125). Croy uses an inflatable packer to separate the liquid and gas systems, and includes separate piping for the gas and liquid so liquid entrainment is not required. Lynch uses ejector pumps to remove the liquids from the well while a blower or fan is used to remove the gases. Neither of systems solve the complexities associated with two-phase entrainment flow.

It would be desirable to have a liquid entrainment device that moves up and down with the water table and is capable of self-regulating the rate of liquid and gas recovery for extended periods of time without complex electronics or injected air. This system could solve the reoccurring problems associated with deadhead conditions, choking, and dry recovery.

SUMMARY

This invention describes an apparatus and means to entrain liquids from a well or reservoir by the use of a buoyant device that moves with the elevation of the water, thus eliminating the problems associated with deadhead conditions, choking and dry recovery.

OBJECTS AND ADVANTAGES

Accordingly, several objects and advantages of our invention are:

(a) the invention provides an apparatus that recovers liquids by entrainment without experiencing deadhead conditions, choking or dry recovery due to fluctuations in the elevation of the liquid level;

(b) the invention provides an apparatus in which the rate of recovery of gas and liquid are maintained at a stable rate to assure that the proper gas-to-liquid ratios are maintained for two-phase conveyance of liquids;

(c) the invention provides an apparatus for two-phase liquid recovery without the need for manual adjustments or electronically controlled devices to regulate the gas-to-liquid ratio and maintain entrainment of liquids;

(d) the invention includes a transition member at the location where the gas and liquid are mixed that is capable of producing secondary venturi vacuum effects to provide for liquid lift not accomplished by ordinary two-phase extraction systems; and (e) the invention maintains the gas recovery point above the level of the liquid at all times to eliminate deadhead conditions.

Further objects and advantages of our invention will become apparent from a consideration of the drawings and ensuing description.

BRIEF DESCRIPTION OF THE DRAWING

A complete understanding of the present invention may be obtained by reference to the accompanying drawing, when considered in conjunction with the subsequent detailed description.

DESCRIPTION OF THE INVENTION

Figure 1:
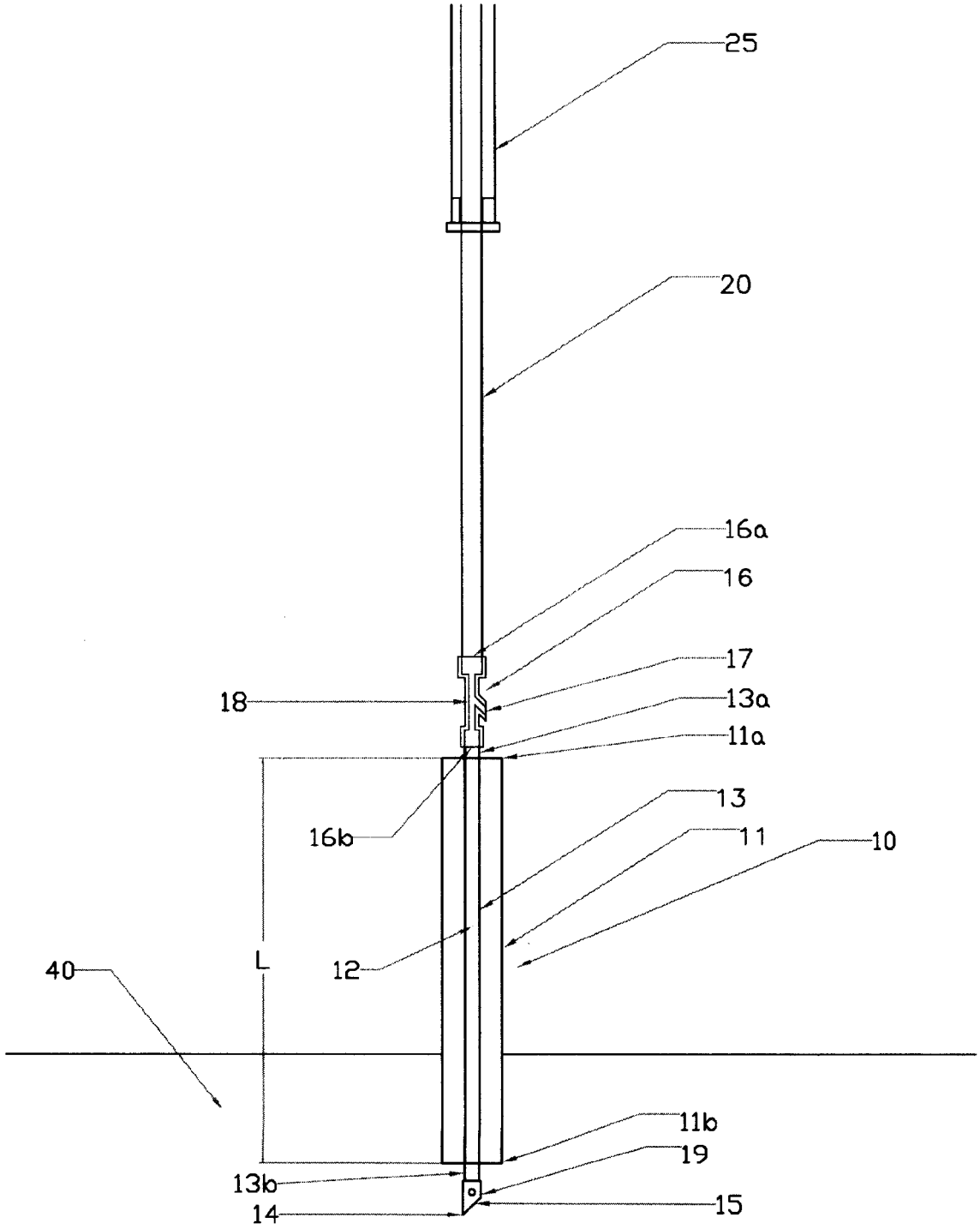
FIG. 1 is a profile view of the apparatus for fluid entrainment according to the present invention.
Figure 2:
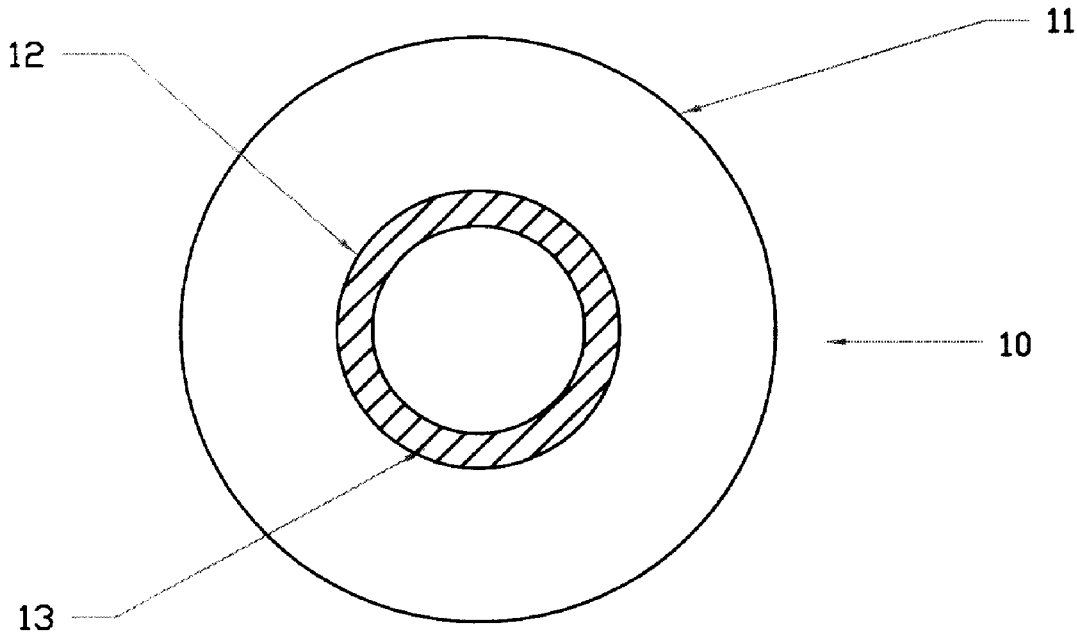
FIG. 2 is a plan view of the apparatus for fluid entrainment according to the present invention.

FIG. 1 (not necessarily shown to scale) is a cross-sectional view of the apparatus for fluid entrainment according to the present invention, shown generally as 10. The apparatus is comprised of a buoyant elongated member 11 that is preferably constructed of a plastic foam material such as polyethylene, polystyrene, polyvinyl, polypropylene, or polyamide to voluminously displace fluid for buoyancy while providing chemical compatibility with chemicals or contaminants located within the fluid 40. FIG. 2 (not necessarily shown to scale) is a top view of buoyant elongated member 11. As shown in FIG. 2, the buoyant elongated member 11 preferably has a cylindrical outer shape with a cylindrical hollowed center 12. However, the shape of the buoyant elongated member may take on multiple other shapes including triangular, square, or other multi-sided shapes without departing from the spirit or scope of the design. Referring back to FIG. 1, the length L of the buoyant elongated member 11 will vary proportionally to the weight of riser pipe 20 that it supports. However, the length L will typically range from two to five feet. The buoyant elongated member 11 also includes a top section 11*a* and a bottom section 11*b* which indicate the orientation of the invention when it is placed into operation.

Figure 5:
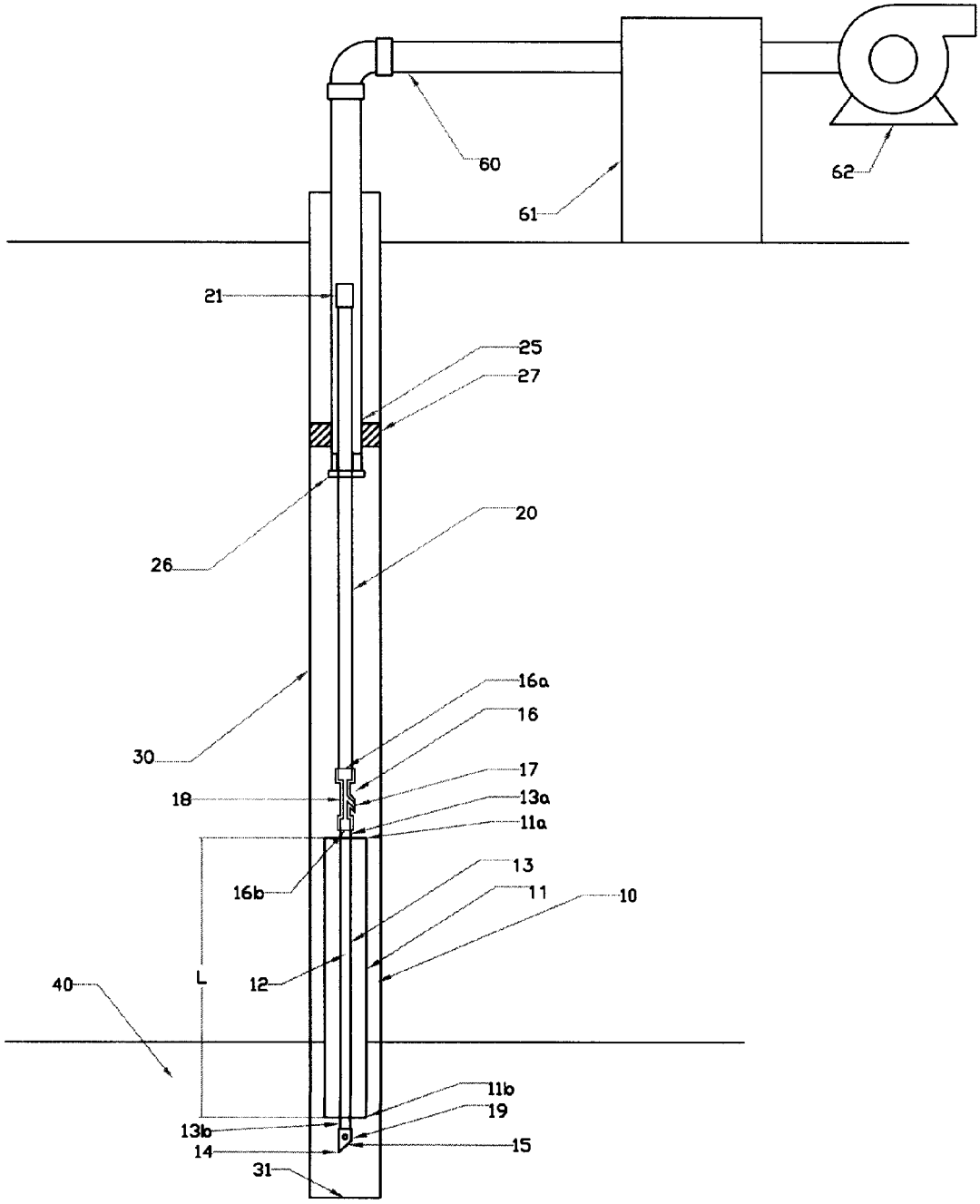
FIG. 5 is a profile view of the fluid entrainment apparatus affixed to a groundwater recovery well with the support pipe connected to a vacuum source and a tank to accumulate entrained liquids.

A hollow tube 13 with a top end 13*a* and bottom end 13*b* is engaged longitudinal to the buoyant elongated member, preferably through the hollowed center 12 of the buoyant elongated member 11. In the preferred design, the hollow tube 13 has an angled bottom edge 14 so that the opening 15 at the bottom end 13*b* is always exposed and not blocked by any underlying objects. FIG. 5 (not necessarily shown to scale) shows a cross-view of the apparatus 10 in use inside a groundwater well 30. This figure demonstrates how the angled bottom edge 14 can prevent the opening 15 at the bottom end 13*b* from creating a vacuum seal with the bottom portion 31 of well 30. As an alternative, or in addition to the angled bottom edge 14, a side opening 19 may be installed near the bottom end 13*b* of the hollow tube 13 to prevent such a vacuum seal from occurring.

Figure 3:
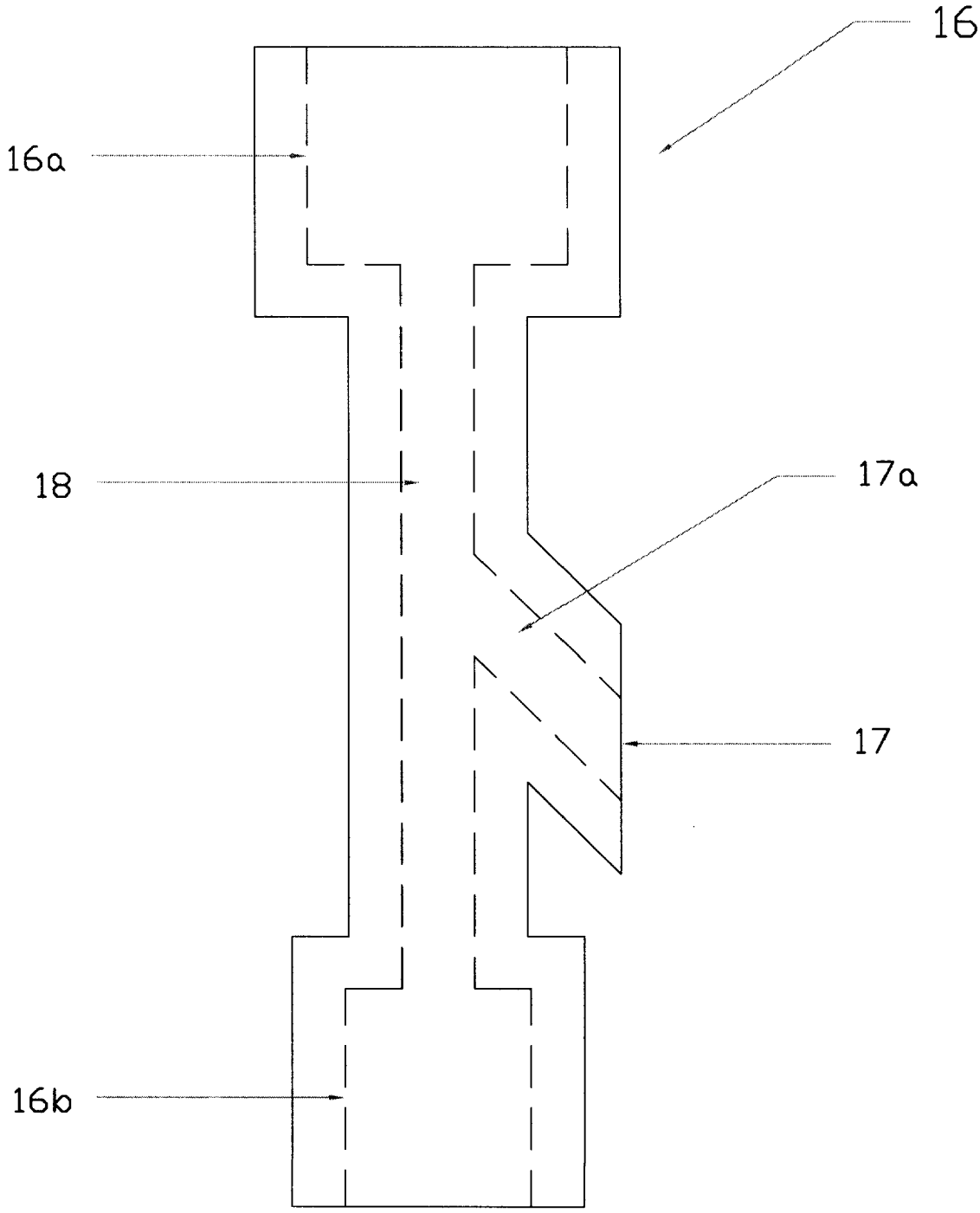
FIG. 3 is a profile view of the transition member which is where the entrainment of gases and fluids occurs.

FIG. 1 shows a hollowed transition member 16 that is engaged with the top end 13*a* of the hollow tube 13. The hollowed transition member is shown in detail in FIG. 3, although not necessarily to scale. The hollowed transition member includes a top opening 16*a*, a bottom opening 16*b*, and a side orifice 17. The side orifice 17 serves as the air intake portion of the apparatus 10 for entrainment of fluid 40. The inner diameter 17*a* of the orifice 17 may vary between individual applications based on the volumetric flow rate of gas that the apparatus 10 is designed to handle for any particular situation. For most applications, the orifice 17 will have an inner diameter 17*a* ranging from ¼-inch to 1-inch to handle typical gas flow ranges from 5 to 80 standard cubic feet per minute. In the preferred design, the orifice 17 enters the hollowed transition member 16 at a 45-degree angle towards the top opening 16*a*. This design creates a venturi effect that enhances the vacuum applied to the bottom end 13*b* of the hollow tube 13, thus assuring that water is pulled up to the elevation of the orifice 17 for gas and liquid entrainment. However, it will be appreciated that the orifice 17 may also enter at any alternative angle, including perpendicularly, since the pressure inside the hollowed transition member 16 will be less than the pressure outside the hollowed transition member 16 due to frictional pressure loss across orifice 17. This differential pressure loss also assists in lifting the liquid in hollow tube 13 to the orifice 17 for gas and liquid entrainment.

Figure 4:
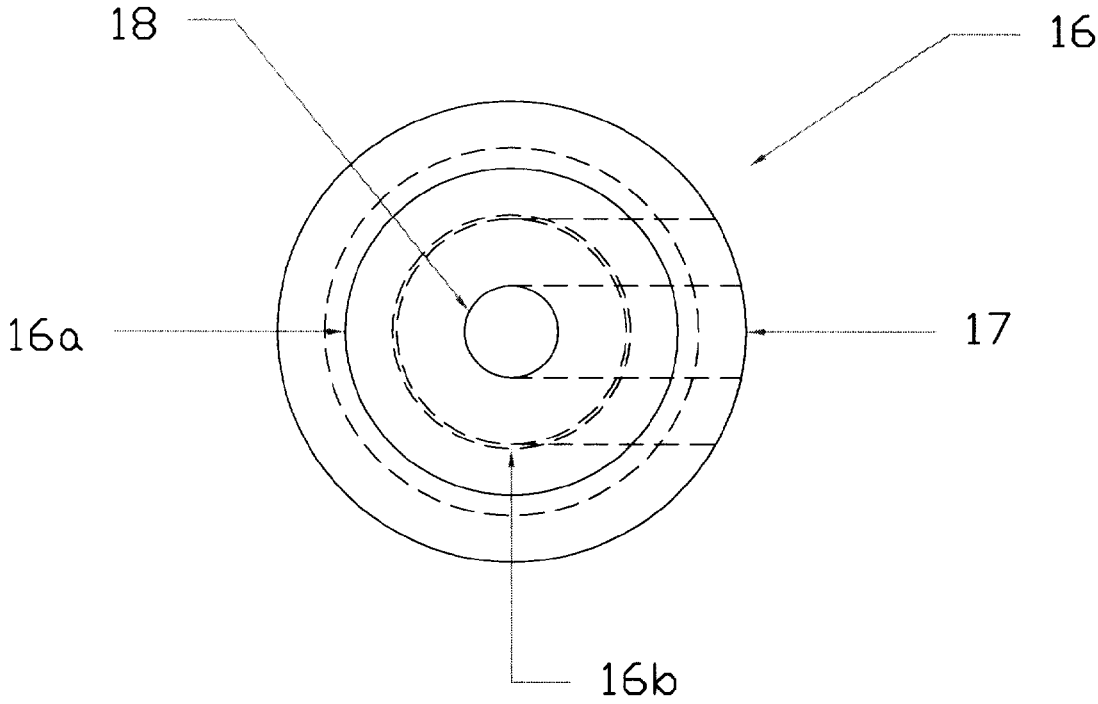
FIG. 4 is a plan view of the transition member.

The central hollowed portion 18 of transition member 16 that extends between the top opening 16*a* and the bottom opening 16*b* may have a smaller diameter than the diameter of top opening 16*a* and the bottom opening 16*b*. The diameter of central hollowed portion 18 may vary between different applications depending upon the volume of gas and liquid that must pass through hollowed portion 18. In some applications, the diameter of the hollowed portion 18 will have the same diameter as top opening 16*a* and bottom opening 16*b*. In many instances, the riser pipe 20 will have a different diameter that the hollow tube 13, thus requiring that top opening 16*a* and bottom opening 16*b* have different diameters. Thus, it will be appreciated that this invention may be practiced using different diameters for the top opening 16*a,* the bottom opening 16*b,* the orifice diameter 17*a,* and the central hollowed portion 18 of transition member 16 without departing from the spirit or scope of the invention. A typical plan view of the hollowed transition member 16 is shown in FIG. 4, although not necessarily to scale.

FIG. 5 shows riser pipe 20 engaged with the top opening 16*a* of transition member 16. The riser pipe 20 is preferably constructed of a strong, light-weight plastic such as polyvinylchloride to minimize both weight and flexibility. The riser pipe 20 is located inside a larger diameter support pipe 25 where it can move telescopically within support pipe 25. Support pipe 25 is further engaged with a groundwater well 30 or other fluid reservoir to prevent movement of support pipe 25. In the preferred design, the riser pipe includes a riser end 21 that is located on the end of the riser pipe 20 located inside the support pipe 25. In addition, the support pipe 25 includes a riser pipe stopper 26 of lesser diameter than the riser end 21 in order to prevent the riser pipe 20 from disconnecting from the support pipe 25. In the preferred design, the inner diameter of riser pipe stopper 26 is less than ⅛-inch larger that the outer diameter of riser pipe 20 in order to reduce undesirable airflow into support pipe 25 at this location. Finally, the support pipe includes an outer stabilizer 27 to assure that the riser pipe 20 and support pipe 25 are centrally located inside the well 30 or other similar reservoir.

Figure 6:
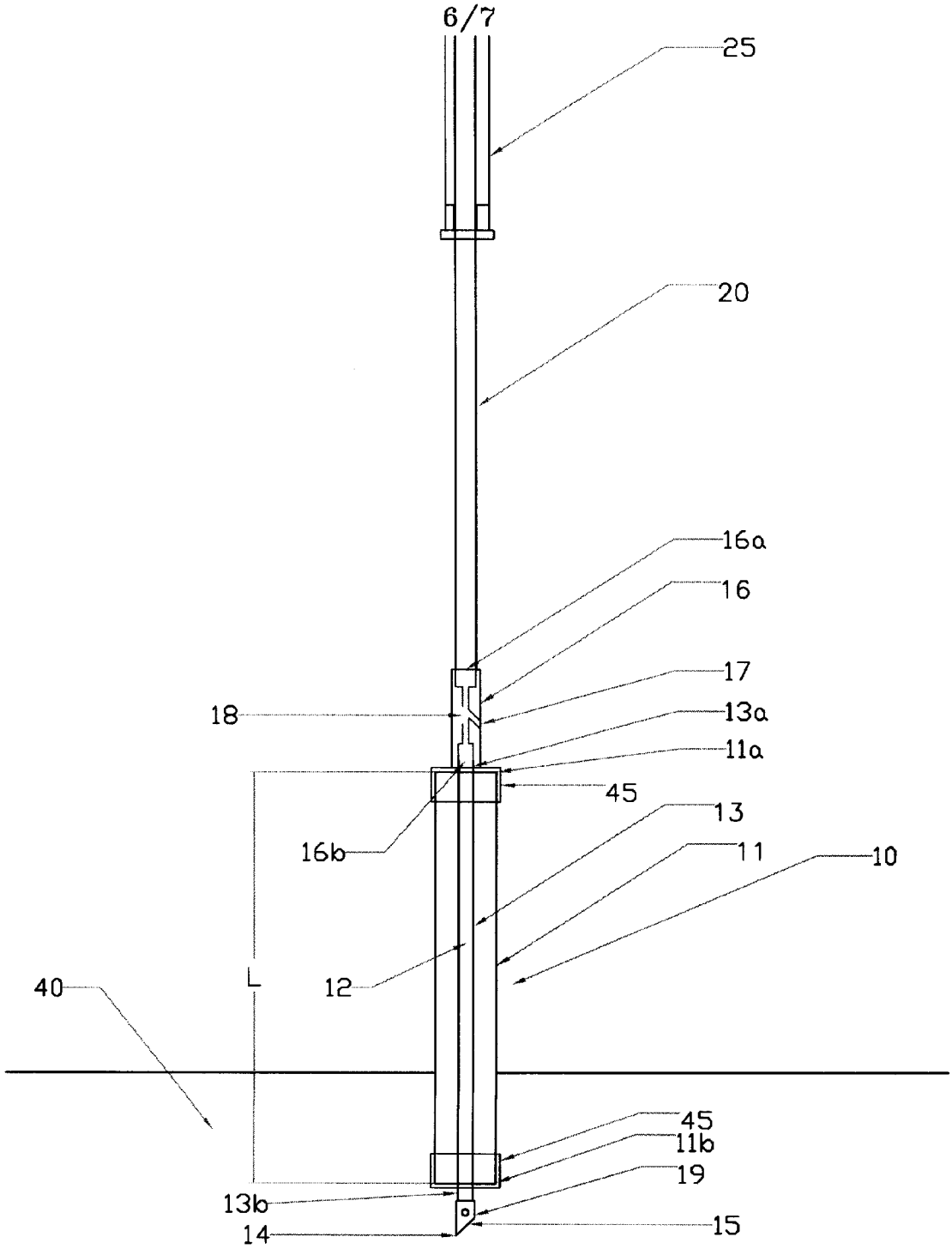
FIG. 6 is a profile view of an alternative design for the fluid entrainment apparatus where the transition member and hollow tube are constructed as a single component using plastic extrusion or injection molding techniques and also including protective caps at the top end and bottom end of the buoyant elongated member.

If plastic extrusion or injection molding techniques are used during fabrication of part or all of the present invention, it may be advantageous to produce two or more elements of the invention as a single component. For instance, hollow tube 13 and transition member 16 may be manufactured as a single component by injection molding techniques. It will be appreciated that the simultaneous manufacturing of the elements of the present invention does not depart from the spirit or scope of the invention. FIG. 6 (not necessarily to scale) shows an alternate design of apparatus 10 where hollow tube 13 and transition member 16 are manufactured as a single component by injection molding. This alternate design also includes protective end caps 45 that fit over the top end 11*a* and bottom end 11*b* of buoyant elongated member 11. The protective end caps 45 may be manufactured to have varying weights so they may be used to balance the buoyancy of buoyant elongated member 11. As shown in FIG. 6, the top protective end cap 45 may be fabricated as a single component with hollow tube 13 and transition member 16 without departing from the spirit or scope of the invention.

Figure 7:
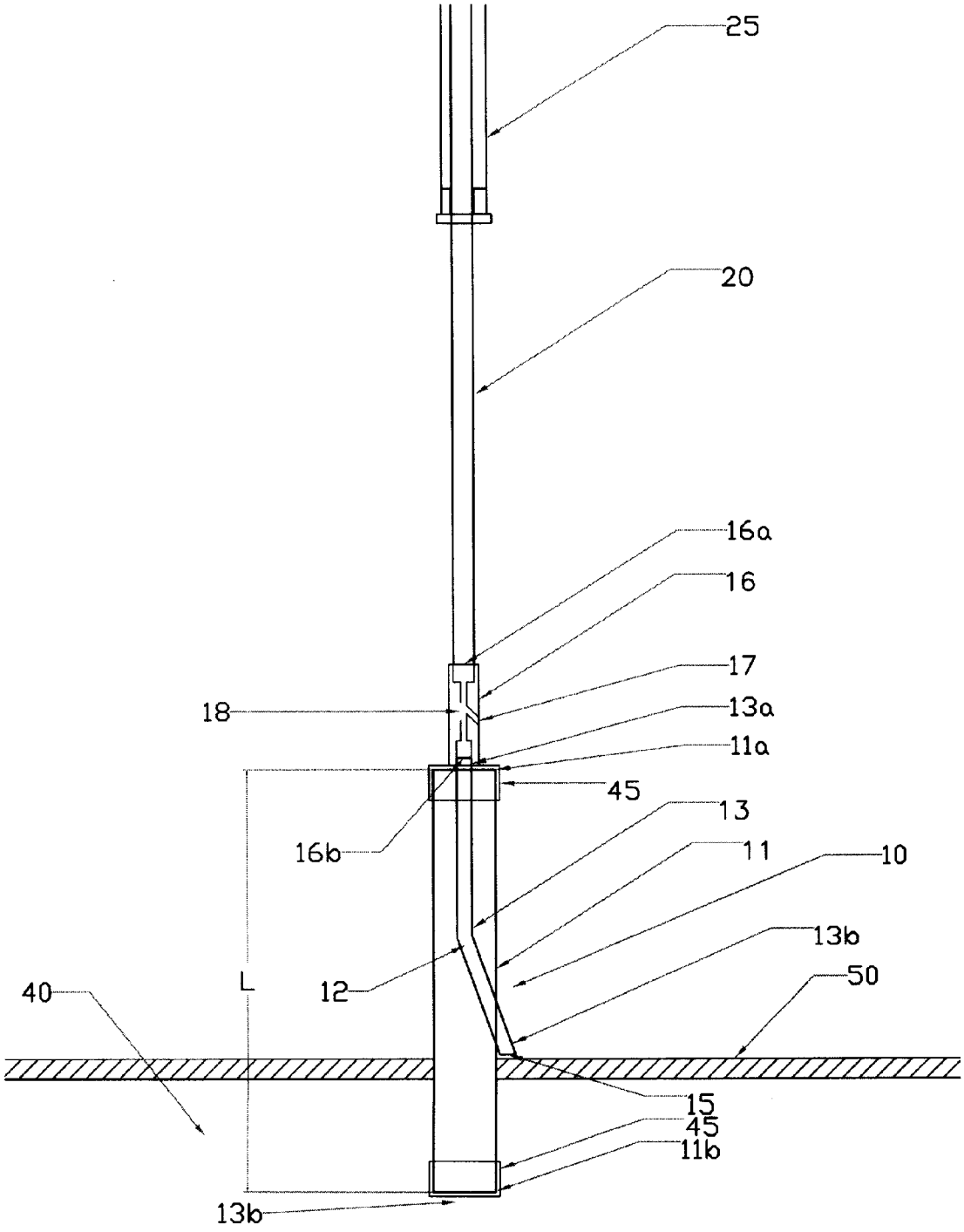
FIG. 7 is a profile view of an alternative design for the fluid entrainment apparatus where the hollow tube is constructed across only a portion of the buoyant elongated member so entrainment can focus on the recovery of free-phase contaminants that float on water.

FIG. 7 (not necessarily to scale) shows the apparatus 10 in yet another alternate design where the apparatus 10 has been modified to focus recovery on a floating, less-dense fluid 50 that is located on top of a denser fluid 40. Without departing from the scope of the current invention, the bottom opening 13*b* of hollow tube 13 is engaged longitudinal with buoyant elongated member 11 across only the portion of elongated member 11 that floats above the denser fluid 40, thus allowing preferential recovery of the less dense fluid 50.

The present invention provides a useful apparatus for improved recovery of fluids by two-phase extraction. The process for recovery of fluids with the present invention is shown in FIG. 5. The process includes placing the apparatus 10 into a fluid reservoir such as a well 30, connecting a vacuum manifold 60 to support pipe 25 to induce a flow of gas through apparatuslo, installing a vacuum source 62 to the vacuum manifold 60, and connecting a tank 61 between said support pipe 25 and said vacuum source 62 to collect entrained liquids. Although disclosed and described with respect to the depicted schematic arrangements of the preferred embodiment of the present invention, it should be appreciated that other, equivalent embodiments will be apparent to those skilled in the art and are within the scope of the invention as set forth in the foregoing disclosure and appended claims and drawing figures.

Conclusion, Ramifications, and Scope

Accordingly, the reader will see that the present invention provides an improved apparatus and method for two-phase fluid recovery because the invention provides an apparatus that recovers liquids by entrainment without experiencing deadhead conditions, choking or dry recovery due to fluctuations in the elevation of the liquid level. In addition, the invention provides an apparatus and method for liquid two-phase recovery where the rate of recovery of gas and liquid are self-regulated by the construction design of the apparatus, thus eliminating the need for manual adjustments or electronically controlled devices to regulate the gas-to-liquid ratio and maintain entrainment of liquids. Finally, the invention includes a transition member at the location where the gas and liquid are mixed that is capable of producing secondary venturi vacuum effects to provide for liquid lift that is not accomplished by ordinary two-phase extraction systems, and the present invention maintains this gas recovery point above the level of the liquid at all times to eliminate deadhead conditions.

We claim:

1. An apparatus for liquid entrainment comprising:

an elongated member having a bottom section and a top section, said elongated member being constructed of a material that is buoyant in water;

a hollow tube with a top end and a bottom end, said hollow tube engaged longitudinal to said elongated member;

a hollowed transition member with a top opening, a bottom opening, and a side orifice, said bottom opening engaged with said top end of said hollow tube;

a riser pipe engaged with said top opening of said transition member; and a support pipe with a larger diameter than said riser pipe for telescopic movement of said riser pipe therein.

2. The invention of claim 1, where said elongated member is constructed of plastic foam material comprised of polyethylenes, polypropylenes, polyvinyls, polystyrenes, polyurethanes or polyamides.

3. The invention of claim 2, where said foam material has a concentric hollowed portion for placement of said hollow tube.

4. The invention of claim 1, where said side orifice penetrates said transition member at an inward angle towards said top opening of said transition member to create a venturi vacuum effect within said hollow tube.

5. The invention of claim 1, where said hollow tube has a side opening at said bottom end to prevent a vacuum seal between said hollow tube and any object below said hollow tube.

6. The invention of claim 1, where said bottom end of said hollow tube is cut at an angle to prevent a vacuum seal between said hollow tube and any object below said hollow tube.

7. The invention of claim 1, where said hollowed tube and said transition member are manufactured as a single component.

8. The invention of claim 1, where said riser pipe includes a riser end located within said support pipe, and said support pipe includes a riser tube stopper of lesser diameter than said riser end to prevent said riser pipe from disconnecting from said support pipe.

9. The invention of claim 1, where said elongated member includes protective end caps deposed to said top section and said bottom section.

10. The invention of claim 9, where said protective end caps are constructed with different weights to balance the buoyancy of said elongated member.

11. The invention of claim 9, where said protective end caps and said transition member are manufactured as a single component.

12. The invention of claim 1, where a protective coating is applied to said elongated member, said hollow tube, and said transition member.

13. The invention of claim 1, where said support pipe includes an outer stabilizer to centralize said riser pipe and said support pipe inside a well or fluid-filled reservoir.

14. The invention of claim 1, where said bottom end of said hollow tube is engaged longitudinal to said elongated member across only the portion of said elongated member that is not submersed in fluid.

15. A method of liquid entrainment comprising:

placing the apparatus described in claim 1 into a structure or well containing liquid;

connecting a vacuum source to said pipe; and installing a tank between said support pipe and said vacuum source to accumulate entrained liquids.

16. The method of claim 15, where said structure is a well and said liquid is groundwater.

17. The method of claim 15, where said structure is a well and said liquid is a liquid contaminant that floats or sinks in water.

18. The method of claim 15, where said structure includes a means of separating and removing floating or sinking contaminants from water.

* * * * *